US007696887B1

(12) United States Patent
Echavarria

(10) Patent No.: US 7,696,887 B1
(45) Date of Patent: Apr. 13, 2010

(54) PERSON TRACKING AND COMMUNICATION SYSTEM

(76) Inventor: Arturo Echavarria, 13520 SW. 9th Pl., Davie, FL (US) 33325

( * ) Notice: Subject to any disclaimer, the term of this patent is extended or adjusted under 35 U.S.C. 154(b) by 323 days.

(21) Appl. No.: 11/586,241

(22) Filed: Oct. 25, 2006

(51) Int. Cl.
*G08B 23/00* (2006.01)

(52) U.S. Cl. ..... 340/573.1

(58) Field of Classification Search ..... 340/573.1, 340/539.15, 539.21, 692, 539.23
See application file for complete search history.

(56) References Cited

U.S. PATENT DOCUMENTS

| | | | | |
|---|---|---|---|---|
| 4,785,291 | A | 11/1988 | Hawthorne | |
| 4,899,135 | A | 2/1990 | Ghahariian | |
| 4,918,425 | A | 4/1990 | Greenberg | |
| 5,021,794 | A | 6/1991 | Lawrence | |
| 5,086,290 | A | 2/1992 | Murray | |
| 5,115,223 | A | 5/1992 | Moody | |
| 5,223,815 | A | 6/1993 | Rosenthal | |
| 5,289,163 | A * | 2/1994 | Perez et al. | 340/539.32 |
| 5,461,365 | A * | 10/1995 | Schlager et al. | 340/573.4 |
| 5,525,967 | A | 6/1996 | Azizi | |
| 5,530,426 | A | 6/1996 | Wilk | |
| 5,557,259 | A | 9/1996 | Musa | |
| 5,646,593 | A | 7/1997 | Hughes | |
| 5,650,770 | A | 7/1997 | Schlager | |
| 5,652,569 | A | 7/1997 | Gerstenberger | |
| 5,661,460 | A * | 8/1997 | Sallen et al. | 340/573.4 |
| 5,689,240 | A * | 11/1997 | Traxler | 340/573.4 |
| 5,714,932 | A | 2/1998 | Castellon | |
| 5,742,233 | A | 4/1998 | Hoffman | |
| 5,900,817 | A | 5/1999 | Imasakian | |
| 5,939,988 | A * | 8/1999 | Neyhart | 340/573.4 |
| 5,995,007 | A | 11/1999 | Borja | |
| 6,031,460 | A * | 2/2000 | Banks | 340/573.1 |
| 6,075,442 | A | 6/2000 | Welch | |
| 6,127,931 | A | 10/2000 | Mohr | |
| 6,529,131 | B2 | 3/2003 | Wentworth | |
| 6,888,464 | B1 | 5/2005 | Maloney | |
| 7,012,522 | B1 | 3/2006 | Levan | |
| 7,019,643 | B2 | 3/2006 | Lu | |
| 7,038,589 | B2 | 5/2006 | Schmidt | |
| 7,084,757 | B2 * | 8/2006 | Terui | 340/539.11 |
| 7,106,191 | B1 | 9/2006 | Liberati | |
| 7,119,677 | B2 * | 10/2006 | Ziesing | 340/539.15 |
| 2006/0148423 | A1 * | 7/2006 | Sharpe | 455/90.1 |
| 2006/0176178 | A1 * | 8/2006 | Everest et al. | 340/572.1 |

* cited by examiner

*Primary Examiner*—Phung Nguyen
(74) *Attorney, Agent, or Firm*—David P. Lhota, Esq.; Malin Haley DiMaggio Bowen & Lhota, PA

(57) ABSTRACT

A tracking system having a monitored unit and tracking unit with components that generate and transmit a recognizable audible, visual and, or tactile signal when the monitored unit travels beyond the distance threshold from the tracking unit to alarm the monitored person that they have traveled outside a designated safe area. The tracking unit further comprises circuitry and, or processor code that generates and transmits a signal that becomes increasingly stronger as the tracking unit gets closer to the monitored unit so as to generally indicate and direct the location of the monitored unit. The instant invention preferably comprises circuit components that facilitate adjustment of the separation distance required between the monitored unit and tracking unit to activate the alarm signal(s).

13 Claims, 5 Drawing Sheets

"THE TRACKER"
CONCEPTUAL DESIGN FOR CHILD TRACKING & LOCATING SYSTEM
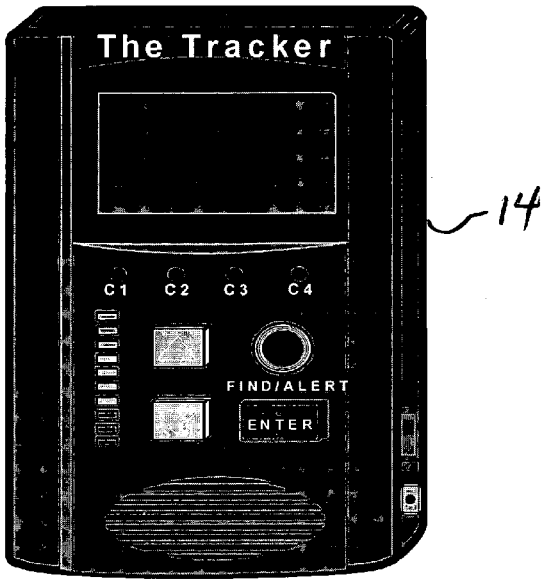
FIG. 3
PARENTAL UNIT / CONTROL MODULE
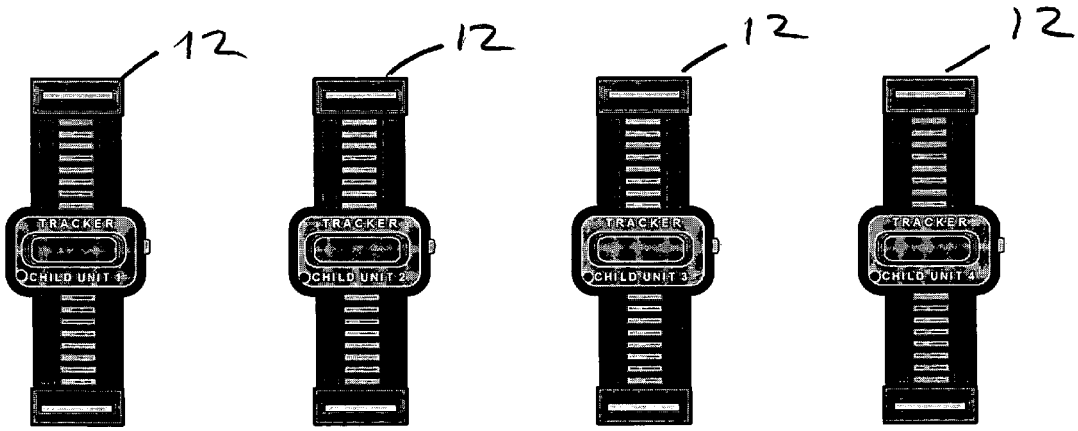
CHILD UNITS

14
Figure 4: Block Diagram of Parental/Monitoring Unit
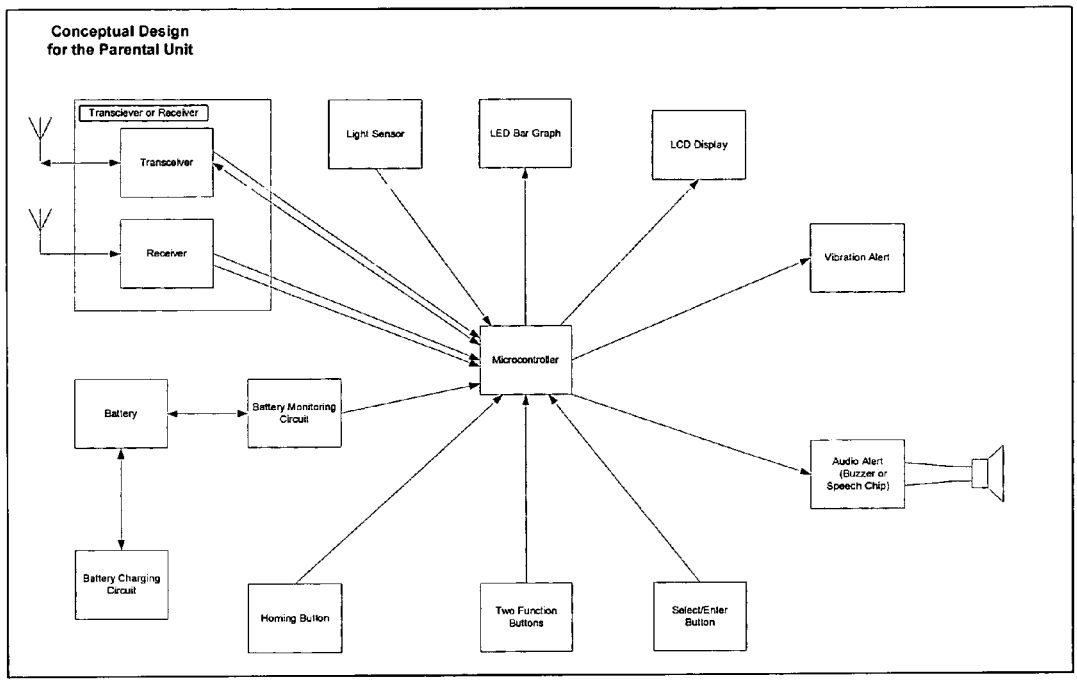

Figure 5: Block Diagram of Child/Monitored Person/Unit
12
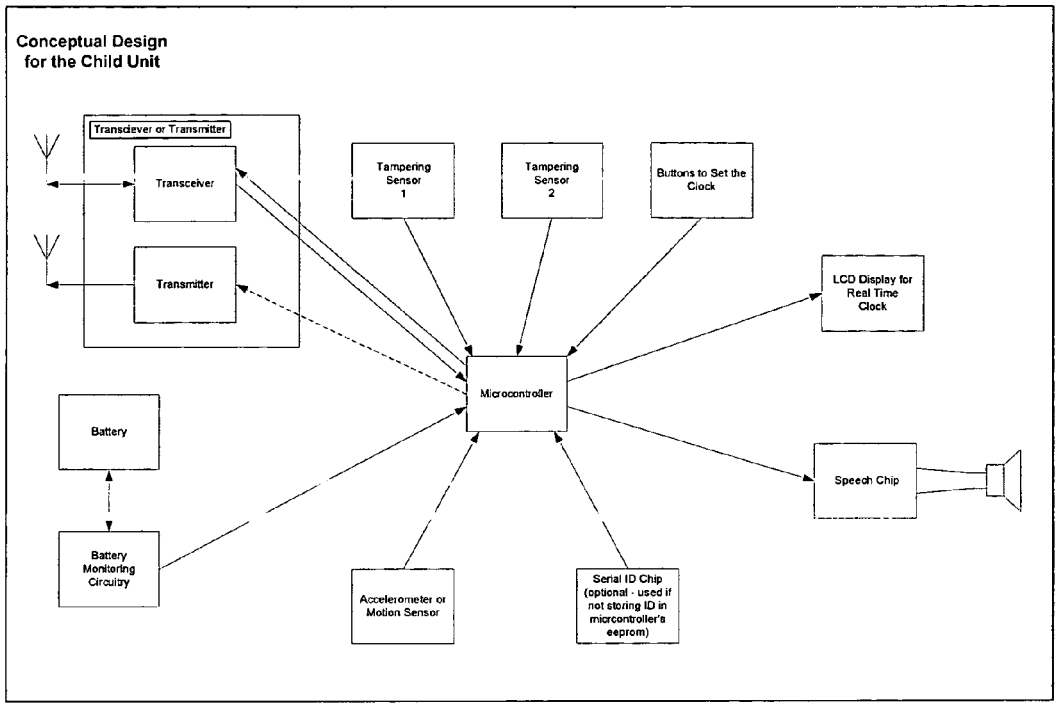

PERSON TRACKING AND COMMUNICATION SYSTEM

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

This invention relates generally to a portable tracking system, and more particularly, to an electronic portable child/person tracking system that monitors a child/person's relative distance from a receiver unit and triggers an alarm when the child's distance exceeds a predetermined threshold.

2. Description of the Background Art

Children and senior citizens are kidnapped or lost every day in the United States and around the world. The problem has become epidemic. Oftentimes this happens when a caretaker is preoccupied. A child or senior citizen can wander off in a matter of seconds unbeknownst to the caretaker. If a warning could be triggered when the child or senior citizen wandered beyond a predetermined distance from the caretaker, the caretaker could recover the child or senior citizen before they are lost or taken. The warning system would provide additional reliability and faster recovery time if it allowed the caretaker and child/senior citizen to communicate.

A variety of tracking systems are known in the art, but they fail to adequately address and resolve the shortcomings of the prior art as contemplated by the instant invention. For instance, U.S. Pat. No. 7,106,191 discloses a child distance monitoring and alerting system, U.S. Pat. No. 7,119,677 discloses a personal monitoring system, U.S. Pat. No. 7,038,589 discloses systems and methods for tracking an object, U.S. Pat. No. 6,888,464 discloses a child locating system, U.S. Pat. No. 6,075,442 discloses a low power child locator system, U.S. Pat. No. 6,127,931 discloses a device for monitoring the movement of a person, U.S. Pat. No. 6,529,131 discloses an electronic tether, U.S. Pat. No. 7,012,522 discloses a child monitoring system, U.S. Pat. No. 5,646,593 discloses a child proximity detector, U.S. Pat. No. 5,900,817 discloses a child monitoring system, U.S. Pat. No. 4,899,135 discloses a child monitoring device, U.S. Pat. No. 5,289,163 discloses a child position monitoring and locating device, U.S. Pat. No. 5,652,569 discloses a child alarm, U.S. Pat. No. 7,019,643 discloses an out-of-range detector, U.S. Pat. No. 4,785,291 discloses a distance monitor especially for child surveillance, U.S. Pat. No. 5,995,007 discloses a proximity monitoring system, U.S. Pat. No. 5,115,223 discloses a personnel location monitoring system and method, U.S. Pat. No. 5,086,290 discloses a mobile perimeter monitoring system, U.S. Pat. No. 5,021,794 discloses a personal emergency locator system, U.S. Pat. No. 4,918,425 discloses a monitoring and locating system for an object attached to a transponder monitored by a base station having an associated ID code, U.S. Pat. No. 5,223,815 discloses a portable anti-theft device, U.S. Pat. No. 5,742,233 discloses a personal security and tracking system, U.S. Pat. No. 5,714,932 discloses a radio frequency security system with direction and distance locator, U.S. Pat. No. 5,650,770 discloses a self-locating remote monitoring systems, U.S. Pat. No. 5,557,259 discloses a proximity alert and direction indicator, U.S. Pat. No. 5,525,967 discloses a system and method for tracking and locating an object, U.S. Pat. No. 5,461,365 discloses a multi-hazard alarm system using selectable power-level transmission and localization and U.S. Pat. No. 5,530,426 discloses a system and associated method for protecting valuable personal possessions.

Based on the foregoing, there exist a need for a system that addresses the shortcomings of the background art. The instant invention addresses this need by providing a system for tracking individuals and facilitating communications as contemplated by the instant invention described herein.

BRIEF SUMMARY OF THE INVENTION

In light of the foregoing, it is an object of the present invention to provide a tracking system that triggers an alarm when a monitored person or device travels beyond a predetermined distance from a monitoring device.

It is also an object of the instant invention to provide a tracking system that transmits a warning signal to a unit or person carrying a unit when they stray beyond a predetermined distance from a central location or receiver unit.

It is another object of the instant invention to provide a tracking system that activates a warning signal from a receiver unit when a targeted person or unit travels beyond a predetermined distance from the receiver unit.

It is an additional object of the instant invention to provide a tracking system having a receiver unit that audibly or visually transmits a signal of increasing or decreasing strength or frequency as the receiver unit gets closer to a transmitting unit.

It is a further object of the instant invention to provide a tracking system that is adjustable with respect to the required distance a transmitter should be from the receiver to sound an alarm or alarms.

In light of these and other objects, the instant invention is a tracking system that warns when a person or device travels beyond a predetermined distance from a tracking component. The instant invention will allow children or geriatric persons to maneuver within a predetermined radius from a portable central or monitoring point that warns them and, or their caretaker if they or the object stray beyond a predetermined distance. The instant invention comprises a monitored unit worn or otherwise disposed on a person or object to be monitored as to distance traveled from a tracking unit and tracking unit that sends and, or receives wireless signals to and, or from the monitored unit in a manner that indicates whether the monitored unit has traveled beyond a predetermined threshold distance from the tracking unit. The instant invention may comprise one-way or two-way communication between the monitored and tracking units. The monitored unit preferably generates and transmits a recognizable audible, visual and, or tactile signal when the monitored unit travels beyond the distance threshold from the tracking unit to alarm the monitored person that they have traveled outside a designated safe area. The tracking unit preferably generates and transmits a recognizable audible, visual and, or tactile signal when the monitored unit exceeds a preprogrammed or selected distance from the tracking unit to alarm the cognizant caretaker that the tracking unit or person has exceeded a designated distance. In a preferred embodiment, the tracking unit further comprises circuitry and, or processor code that generates and transmits a signal that becomes increasingly stronger as the tracking unit gets closer to the monitored unit so as to generally indicate and direct the location of the monitored unit. The instant invention preferably comprises circuit components that facilitate adjustment of the separation distance required between the monitored unit and tracking unit to activate the alarm signal(s). In an alternative embodiment, the signal may get weaker as the tracking unit approaches the monitored unit. In another alternative embodiment, the instant invention may comprise power saving circuitry wherein available power in the monitored unit and, or tracking unit is reduced when said devices are stationary or essentially stationary.

In accordance with these and other objects, which will become apparent hereinafter, the instant invention will now be described with particular reference to the accompanying drawings.

BRIEF DESCRIPTION OF THE SEVERAL VIEWS OF THE DRAWINGS

FIG. 3 is a system diagram of the preferred embodiment of the tracking system incorporating four person tracking units in accordance with the instant invention.

FIG. 4 is a circuit block diagram of the tracking unit, also referenced as a parental monitoring unit, in accordance with the instant invention.

FIG. 5 is a circuit block diagram of the monitored unit, also referenced as a child or person monitored unit, in accordance with the instant invention.

DETAILED DESCRIPTION OF THE INVENTION

Figure 1:
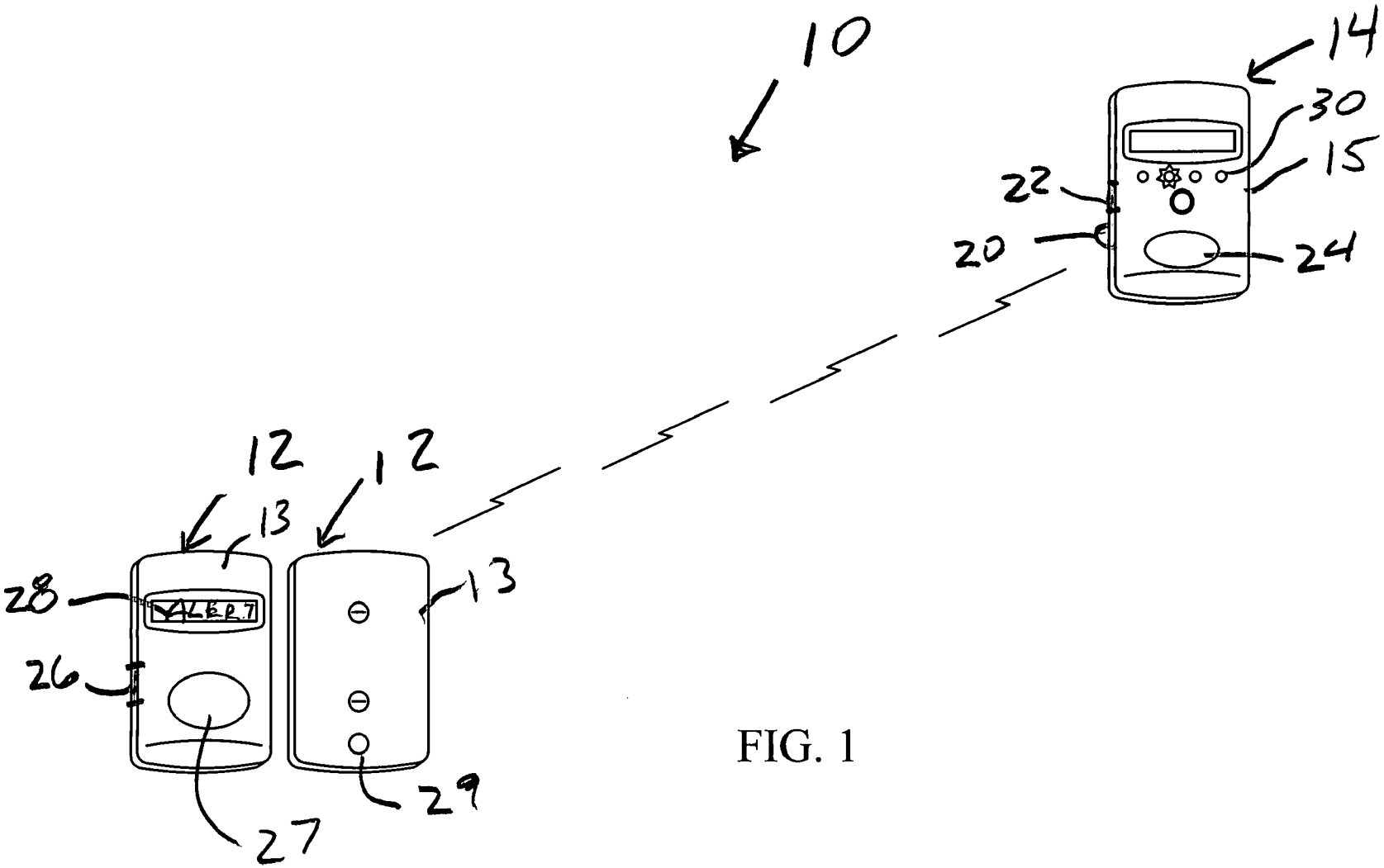
FIG. 1 is a system diagram view of the preferred embodiment of the tracking system in accordance with the instant invention.
Figure 2:
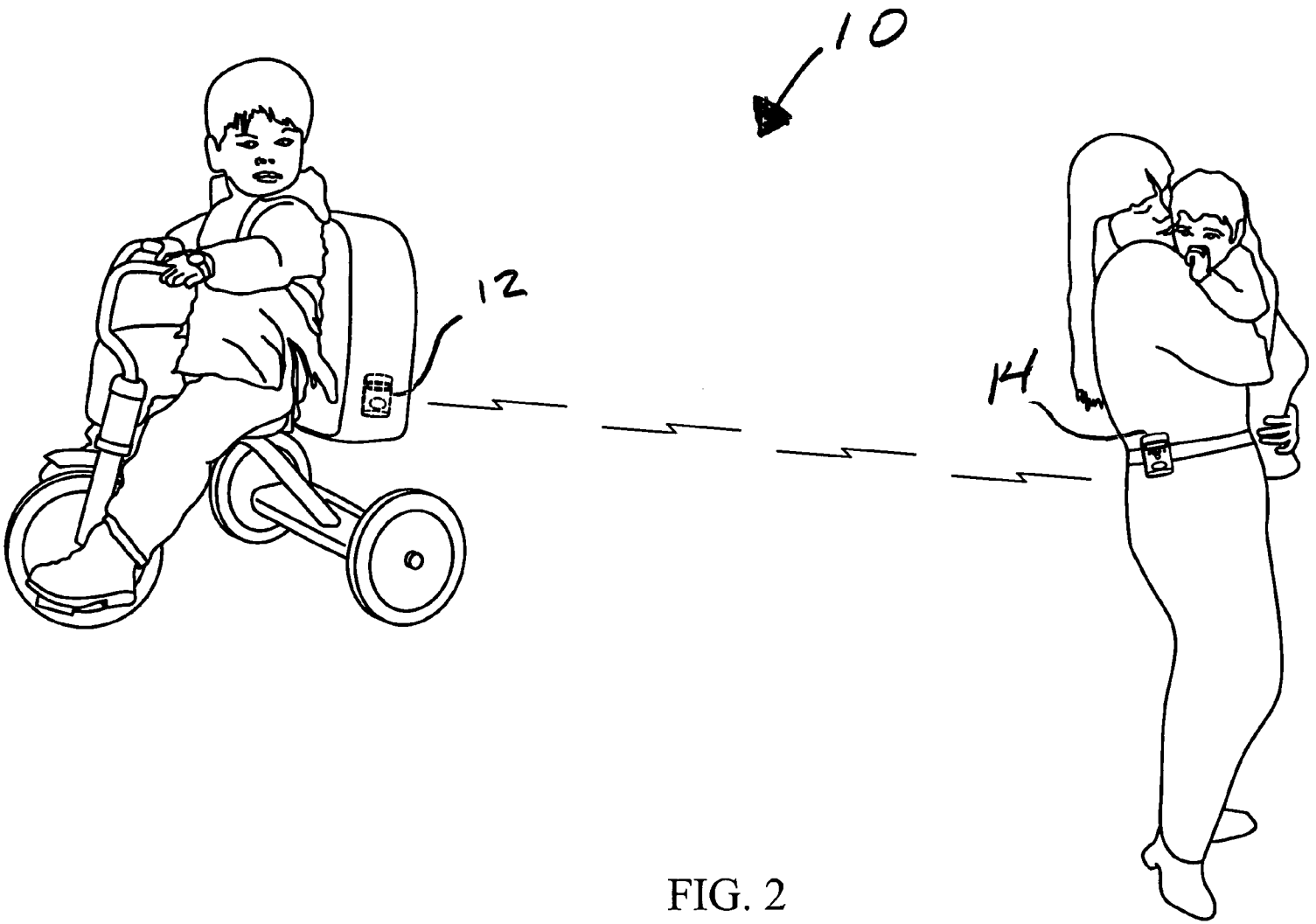
FIG. 2 is a system diagram view of the preferred embodiment of the tracking system in use in accordance with the instant invention.

With reference to the drawings, FIGS. 1-5 depict the preferred embodiments of the instant invention which is generally referenced as a tracking system and, or by numeric character 10. The tracking system 10 comprises an electrically powered portable security, tracking and communication system that warns when a monitored component 12 is taken past a predetermined distance from a tracking component 14, which is in wireless communication with the monitored component 12. The tracking system 10 of the instant invention will allow children or geriatric persons to maneuver within a predetermined radius from a portable central point and warn them and, or their caretaker if they stray beyond a predetermined distance. The tracking system 10 may also include circuitry that facilitates communication between the transmitter unit 12 and receiver unit 14.

With reference to FIGS. 1-5, the tracking system 10 generally comprises a portable monitored unit 12 with circuitry for wireless communication with a tracking unit 14 having cooperating circuitry for facilitating wireless communication. In the preferred embodiment, the tracking unit 14 and monitored unit 12 have circuitry that activates an alarm signal for activating an audible, visual and, or tactile alarm in the tracking unit 14 and, or monitored unit 12 when the distance between them exceeds a predetermined distance. In the preferred embodiment, the tracking unit 14 and monitored unit 12 comprise electrical circuit components that are triggered when the distance between the tracking unit 14 and monitored unit 12 exceeds a predetermined or preset distance. In another embodiment, the monitored unit 12 transmits a signal to the tracking unit 14 having circuitry that receives and monitors the strength of the signal received to determine if the monitored unit 12 has traveled beyond a predetermined distance from the tracking unit and generates an audible, visual or tactile warning signal if it has. In another embodiment, the monitored unit 12 transmits a signal to the tracking unit 14 having circuitry that receives and monitors the strength of the signal received to determine if the monitored unit 12 has traveled beyond a predetermined distance from the tracking unit and generates an audible, visual or tactile warning signal if it has.

The monitored unit 12 preferably includes a waterproof housing 13, speaker 27 and circuitry for transmitting a signal. In an alternative embodiment, the monitored unit may also include circuitry that enables the person holding the unit 12 to talk to the person holding the tracking unit 14. The monitor unit 12 may include a switch or button 26 that allows the person to transmit their voice, display screen 28, circuitry mounting devices that reduce shock, rechargeable battery, waterproof battery charging DC input connector 29 and short range radio wave communication circuitry. The tracking unit 14 comprises circuitry in a waterproof housing 15 for receiving, transmitting and, or processing signals from the monitored unit 12, circuitry for monitoring and comparing signal strength to determine whether the transmitter unit 12 has traveled beyond a predetermined distance, internal direction finding dipole antenna 17, adjustable distance controller 20 for setting the distance that triggers the warning alarm and speaker 24. The tracking unit 14 may also include circuitry for transmitting signals, such as alarms, data or voice, switch 22 that triggers the transmission of a signal or voice and LED's 18 that represent a plurality of different monitoring transmitters. The tracking system 10 may also include a remote alarm, which may be placed in a watch or clothing, that is carried or worn by the person with the receiver 12 and triggers an alarm when the receiver unit 12 has traveled beyond the permitted area.

The portable monitored unit 12 may transmit a continuous or intermittent coded signal of constant power for receipt by the tracking unit 14. The signal is received by the remote portable tracking unit 14 and processed by the signal strength comparing circuit, which compares the signal strength to the strength of a previously received signal. A decrease in signal strength indicates an increase in the distance between the monitored unit 12 and tracking unit 14. If the signal strength drops below a predetermined value, which coincides with a threshold separation distance, the unit 14 triggers an alarm to warn the caretaker and may also send an alarm signal to the monitored unit 12 to warn the person being monitored. The remote portable tracking unit 14 may also include circuitry for manually sending a signal to the portable monitored unit 12, wherein this signal may be an alarm, data or instructions. An alarm or other indicating device 30 may be worn separately from the monitored unit 12 and receives the signal from the tracking unit 14.

The tracking system 10 may be manufactured to operate at any suitable frequency or within a predetermined range. However, certain frequency bands may be more suitable for operation than others. The transmitter and receiver units 12, 14 may be attached to the torso or limbs with a locking strap or carried in a pocket or clip. The alarm device may be located internal to the portable transmitter 12 or it may be a wrist-worn alarm or indicator. A two-way communication system may be incorporated into the transmitter 12 and receiver 14 to facilitate communication between the parties. The receiver unit 14 may have an internal direction finding dipole antenna, omni directional antenna or external direction finding dipole antenna.

The housings 13, 15 are preferably made from a polyvinyl chloride (PVC) plastic but may also be manufactured from similar plastic material or metal. The electronic circuitry of the transmitter and receiver units 12, 14 may comprise solid state components, silicon, silicon-germanium or gallium arsenide based integrated circuits. Conventional passive electronic components may be used as required. The wrist-worn alarm unit 30 may be manufactured from plastic, metal, nylon or stainless steel. The attachment bands may be made from nylon fabric with or without metal reinforcing wires.

Based on the foregoing, the tracking system 10 of the instant invention is an electrically powered portable security, tracking and communication system that warns when a component 12 is taken past a predetermined distance from a transmitter/receiver 14. The invention 10 includes a transmitter 12 and receiver 14 with corresponding audio and, or visual indicating features. The portable transmitter unit 12 may transmit at least one signal continuously or intermittently. The transmitted signal may be coded for frequency modulation or pulse modulation. The transmitted signal is preferably maintained at a constant power level. The receiver unit 14 circuitry includes a signal strength comparing circuit and associated memory for storing and accessing previously received signals. The receiver 14 may include a microprocessor to compute the variations in signal strength and translate the difference into changes in distance between the transmitter 12 and receiver 14. The circuitry of the instant invention 10 monitors the distance between the transmitter 12 and receiver 14 and produces and transmits an alarm-producing signal when the distance is greater than a predetermined limit. The transmitter unit 12 and receiver unit 14 may be configured to manually exchange signals. The signals may comprise an alarm, data or instructions. An independent alarm or other indicating device may be worn separately but in electrical communication with the transmitter 12. The preferred location of a remote alarm or other indicating device 30 is on the wrist. The housings 13, 15 and remote alarm may be painted, colored or stenciled to display a logo, emblem or other graphic representation. The invention's remote alarm may contain a watch or other secondary function. The invention may contain a replaceable or rechargeable battery. The invention's housing may contain a dipole antenna for direction finding. The invention's housing may contain an omni directional antenna.

The tracking system 10 produces a warning signal when a monitored unit 12 is moved a predetermined distance from a tracking unit 14. To insure proper operation, the batteries should be charged or periodically replaced. The transmitter 12 and alarm components are strapped or secured to the person being monitored or placed in their pocket or backpack. The receiver unit 14 is strapped or secured to the person doing the monitoring. The transmitter 12 and receiver 14 must be activated to work. The desired threshold separation distance between the transmitter 12 and receiver 14 for triggering an alarm signal may be set or adjusted or comprise fixed distance.

With reference to FIG. 4, the tracking/parental-unit 14 comprises a microcontroller that is the link between all inputs and outputs in the parental unit 14. It will be responsible for all message processing. Referring to the tracking or Receiver/Transceiver unit 14, the parental unit 14 can simultaneously track up to four or more child/person units 12. The operating frequency of the parental and child units 14, 12 may be in the range of 300-470 MHz. The receiver or transceiver will receive data packets from each child in a timed sequence. If a receiver is used, the microcontroller will receive an RSSI signal and the data packet. The RSSI signal is used to detect the distance that the transmitting child is from the parental unit. The data packet will include the following information:

Child ID
Tampering Status
Relative Moving Speed
Approximate Battery Life

If a transceiver is used in the parental design, the parent will have the option to transmit data packets to any of the four children independently. The data packet will include the following information:

Child ID
Type of Message
Message Data
One Byte for Error Detection

Upon receiving this message, the child unit will play one of its preprogrammed messages. With respect to light sensors, the tracking/parental unit 14 will have a light sensor to control a backlight for the LCD display. If the sensor detects that it has become dark, the backlight will be enabled. The backlight will normally be disabled to save battery consumption. The parental unit 14 will feature an led bar graph that will be used in the "Homing Mode". In this mode, the parental unit is searching for the child that has been detected to be out of range. The led bar graph will have three colors: red, yellow, and green. Once homing begins, the first red bar of the led bar graph will be lit. As the parent moves toward the child that is out of range, the led bar graph will enable or disable the next or previous led to indicate to the parent whether or not they are approaching the child that is out of range. The LCD display will be used to display information to the parent. Possible displayed information will be:

Child Battery Life
Parental Battery Life
Which Child is Out of Range
Selected Function
All Children in Range
Homing Mode
Tampering Status of Each Child
Child moving speed (fast, slow, or idle)

With respect to the vibration alert, if the parental unit detects that one of the tracked children's units has been tampered with or they have gone out of range, a vibration alert will be initiated. The microcontroller will enable an internal motor to "vibrate" until the parent clears the issued alert. An audio alert in the form of a buzzer or preprogrammed speech chip will be integrated in the parental unit. An audio alert will be issued and enabled by the microcontroller for the same conditions listed in Vibration Alert. In the case of a speech chip, one of several preprogrammed messages will be played depending on the data packet received. For example, if the data packet has revealed that the child's unit was tampered with then a message stating this would be played. The instant invention may have a homing circuit and button. If this button is pressed, the parental unit will start homing in on the child who is out of range or who is at the greatest distance from the parent. If the parental unit is designed to have a transceiver, it will tell the selected child unit to send data packets more frequently. Homing will continue until parent exits the mode.

Still referring to FIG. 4, the tracking/parental unit 14 of the invention 10 may have a Function Buttons/Enter Button wherein if the operator wants to access a particular function available in the parental unit they will press the up or down arrow button which will bring up the available functions on the led display. Once the parent sees the function of choice, they will press the enter button to select the function. The possible functions that will be available are:

Enter a child's name for the selected child unit

Set the distance for each child independently

Send a selected child unit a message to play one of the preprogrammed messages

Add another child to be tracked

Test selected child's unit

Still referring to FIG. 4, the Battery, Battery Monitoring and Battering Charging Circuit of the tracking/parental unit 14 may be powered by a Lithium-Ion Battery to allow the operator of the tracking unit 14 to charge the unit daily, if necessary. The unit 14 preferably has the flexibility of being powered by a 12 VDC car adapter. The battery voltage will be monitored and periodic statuses of the remaining battery life will be displayed to the parent.

With reference to FIG. 5, the monitored unit 12 also includes a microcontroller. The microcontroller is the link between all inputs and outputs in the monitored/child unit 12. It will be responsible for all message processing. The child unit 12 transmits data packets to the parental unit 14 periodically. The time between transmission of data packets is dependent on how fast the child is moving or if the child is out of range, which would increase the frequency of data packets being transmitter. The data packet transmitted includes the following information:

Child ID

Tampering Status

Relative Moving Speed

Approximate Battery Life

If a transceiver is used in the child design, the child will be able to receive messages from the parental unit. The message received will be as follows:

Child ID

Type of Message

Message Data

One Byte for Error Detection

Upon receiving this message, the child unit will process the message and perform the action requested by the parental unit. For example, the parent may send a message to play one of the preprogrammed messages or test the selected child unit.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

The invention claimed is:

1. A person tracking system, said system comprising:

a monitored unit mountable to a person or object having circuitry for wireless communication;

a tracking unit having circuitry for wireless communication with said monitored unit;

said tracking unit circuitry comprising a micro controller and means for monitoring a plurality of said monitored units;

said monitored unit comprising a microcontroller and at least one tampering sensor to detect tampering with said monitored unit;

means in said tracking unit for producing a signal that indicates whether the tracking unit is getting closer to the monitored unit; and means, in communication with said monitored unit or tracking unit, for triggering an alarm when said monitored unit reaches a predetermined distance from said tracking unit.

2. The system as recited in claim 1, further comprising:

means for adjusting the distance required to trigger said alarm triggering means.

3. The system as recited in claim 1, wherein said triggering means comprises:

means for transmitting and receiving an RSSI signal between said tracking unit and said monitoring unit.

4. The system as recited in claim 1, wherein said triggering means comprises:

means for transmitting and receiving data packets between said tracking unit and said monitoring unit.

5. The system as recited in claim 1, wherein said triggering means comprises:

means for generating a vibration alert.

6. The system as recited in claim 1, wherein said tracking unit comprises:

a least one light sensor.

7. The system as recited in claim 1, wherein said tracking unit comprises:

battery monitoring circuit.

8. The system as recited in claim 1, wherein said monitored unit comprises:

battery monitoring circuit.

9. The system as recited in claim 1, wherein said monitored unit comprises:

a motion sensor.

10. The system as recited in claim 1, wherein said monitored unit comprises:

an accelerometer.

11. The system as recited in claim 1, wherein said monitored unit comprises:

a serial identification chip.

12. The system as recited in claim 1, wherein said monitored unit comprises:

a transceiver and a receiver for transmitting and receiving signals.

13. The system as recited in claim 1, wherein said tracking unit comprises:

a transceiver and a receiver for transmitting and receiving signals.

* * * * *